US006745662B2

(12) United States Patent
Ford

(10) Patent No.: US 6,745,662 B2
(45) Date of Patent: Jun. 8, 2004

(54) CROSS CELL SANDWICH CORE

(75) Inventor: Donald B. Ford, Huntsville, AL (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/922,169

(22) Filed: Aug. 6, 2001

(65) Prior Publication Data

US 2003/0024378 A1 Feb. 6, 2003

(51) Int. Cl.[7] ..... F41H 5/04
(52) U.S. Cl. ..... 89/36.02; 89/36.11; 428/116
(58) Field of Search ..... 89/36.02, 36.05, 89/36.11; 2/2.5; 428/116, 117, 118

(56) References Cited

U.S. PATENT DOCUMENTS

| | | | | | |
|---|---|---|---|---|---|
| 2,190,490 | A | * | 2/1940 | Sendzimir | 89/36.02 |
| 3,869,778 | A | * | 3/1975 | Yancey | 52/635 |
| 4,020,205 | A | * | 4/1977 | Haselbauer | 428/116 |
| 4,027,058 | A | * | 5/1977 | Wootten | 428/117 |
| 4,471,013 | A | * | 9/1984 | Welzen | 428/116 |
| 4,923,544 | A | * | 5/1990 | Weisse | 428/116 |
| 4,923,728 | A | * | 5/1990 | Snedeker | 2/2.5 |
| 5,028,474 | A | * | 7/1991 | Czaplicki | 428/178 |
| 5,067,388 | A | | 11/1991 | Crews et al. | |
| 5,102,723 | A | | 4/1992 | Pepin | |
| 5,116,688 | A | * | 5/1992 | Minamida et al. | 428/582 |
| 5,161,756 | A | | 11/1992 | Redmon, Jr. et al. | |
| 5,221,807 | A | | 6/1993 | Vives | |
| 5,398,889 | A | * | 3/1995 | White et al. | 244/119 |
| 5,443,884 | A | | 8/1995 | Lusignea et al. | |
| H1621 | H | * | 12/1996 | Ray | 428/174 |
| 5,601,258 | A | | 2/1997 | McClymonds | |
| 5,624,088 | A | | 4/1997 | Fiore | |
| 5,686,689 | A | | 11/1997 | Snedeker et al. | |
| 5,747,721 | A | | 5/1998 | Speakes et al. | |
| 5,848,767 | A | | 12/1998 | Cappa et al. | |
| 6,274,216 | B1 | * | 8/2001 | Gonidec et al. | 428/116 |
| 6,395,372 | B1 | * | 5/2002 | Bach | 428/116 |

FOREIGN PATENT DOCUMENTS

| | | | | |
|---|---|---|---|---|
| EP | 172 415 | * | 2/1986 | 89/36.02 |

* cited by examiner

*Primary Examiner*—Stephen M. Johnson
(74) *Attorney, Agent, or Firm*—James J. McGroary; Stephen J. Stark

(57) ABSTRACT

A sandwich core comprises two faceplates separated by a plurality of cells. The cells are comprised of walls positioned at oblique angles relative to a perpendicular axis extending through the faceplates. The walls preferably form open cells and are constructed from rows of ribbons. The walls may be obliquely angled relative to more than one plane extending through the perpendicular axis.

7 Claims, 2 Drawing Sheets

CROSS CELL SANDWICH CORE

ORIGIN OF THE INVENTION

This invention was made by an employee of the United States Government and may be manufactured and used by or for the Government for governmental purposes without the payment of any royalties thereon or thereof.

BACKGROUND OF THE INVENTION

1. Field of the Invention

This invention relates to a honeycomb structural design, and more specifically, to a sandwich core having rows of cells between layers at oblique angles to the layers.

2. Prior Art

In order to stop hypervelocity particles from penetrating a structure, several methods have been used to protect crucial components. First, a solid structure of sufficient thickness could stop a hypervelocity particle, however, the extra thickness would necessarily translate into extra weight. Another solution has been to provide a secondary "bumper" shield a distance from the structure to be protected. However, the spacing of a secondary shield apart from the protected structure leads to increased volume.

Various other efforts have been made to absorb the impact of high velocity and hypervelocity particles as taught in U.S. Pat. Nos. 5,848,767, 5,747,721, 5,686,689, 6,624,088, 5,601,258, 5,443,884, 5,221,087, 5,161,756, 5,102,723, and 5,067,388. Of these patents, U.S. Pat. No. 5,484,767 shows a spacecraft frame that utilizes a sandwich core, but the design of the core is not addressed, and is believed to be a traditional honeycomb design where the cell walls are substantially perpendicular to the layers. Other sandwich cores are shown in U.S. Pat. Nos. 5,624,088 and 5,443,884.

The traditional sandwich core is typically a honeycomb design having a top layer spaced apart from a bottom layer by a plurality of cells. The cells have a plurality of walls which are perpendicular to each of the layers. FIG. 5*a* of U.S. Pat. No. 5,443,884 illustrates a typical honeycomb sandwich core. These structures are often utilized in spacecraft design since they are stiffer than a single thin structure of the same mass.

The cells of traditional honeycomb sandwich cores are aligned perpendicularly to the facesheets, or layers. Accordingly, when a hypervelocity particle strikes and breaks through the outer facesheet, a plasma jet may form and be channeled through the cell. This jet will be directed by the cell perpendicularly to the inner facesheet. When the plasma jet breaks through the inner facesheet, the particle is then typically directed at the structure which was to be protected.

A need exists to provide a light weight and sufficiently strong sandwich core which may adequately deflect hypervelocity and high velocity particles from damaging a particular structure.

SUMMARY OF THE INVENTION

Consequently, it is a primary object of the present invention to provide a sandwich core which provides a sufficiently strong structure that is relatively light weight and deflects hypervelocity and high velocity particles in a more preferred manner.

Accordingly, the present invention provides a sandwich core comprising two faceplates separated by a plurality of cells. The cells are comprised of walls positioned at oblique angles relative to the perpendicular direction through the faceplates. The walls preferably form open cells and are constructed from rows of ribbons.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
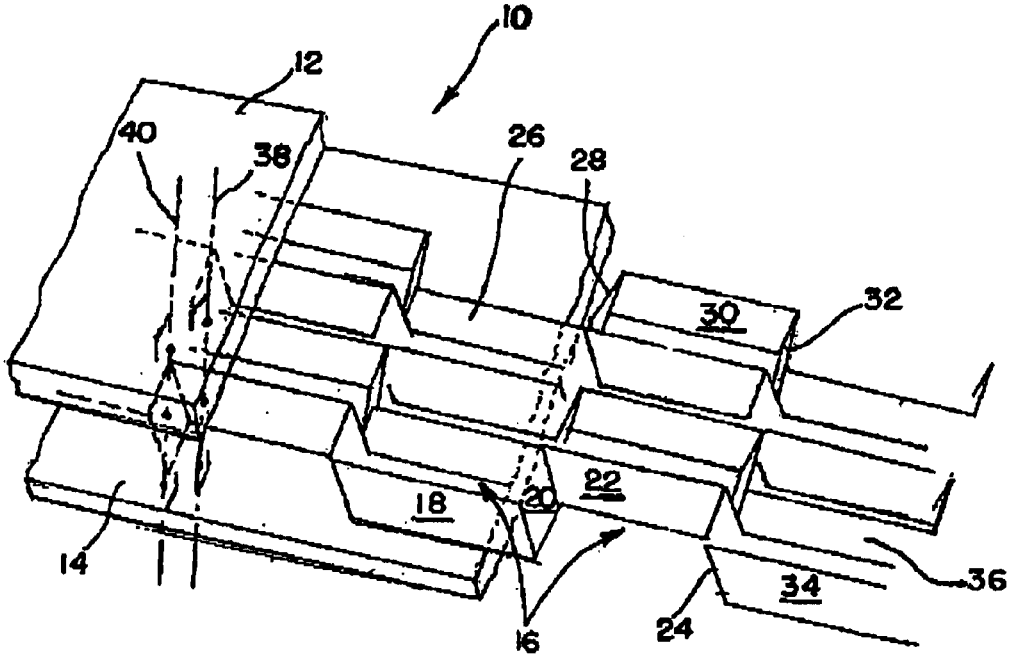
FIG. 1 is a top perspective elevational view of a sandwich core with portions of the faceplates removed to show the internal structure and with axes superimposed on the Figure to illustrate angular arrangements.

Referring to the Figure, a sandwich core 10 is comprised of a first and a second layer 12,14 separated by a cells 16. Cells 16 are voids defined by walls such as walls 18,20,22,24,26,28,30,32. The walls are preferably manufactured in ribbons 34,36.

In FIG. 1, a first and a second ribbon 34,36 are alternatively placed between the faceplates 12,14. The first ribbon 34 has walls 18,20,22,24 in a repeating pattern, while the second ribbon 36 has walls 26,28,30,32 in a repeating pattern.

Figure 2:
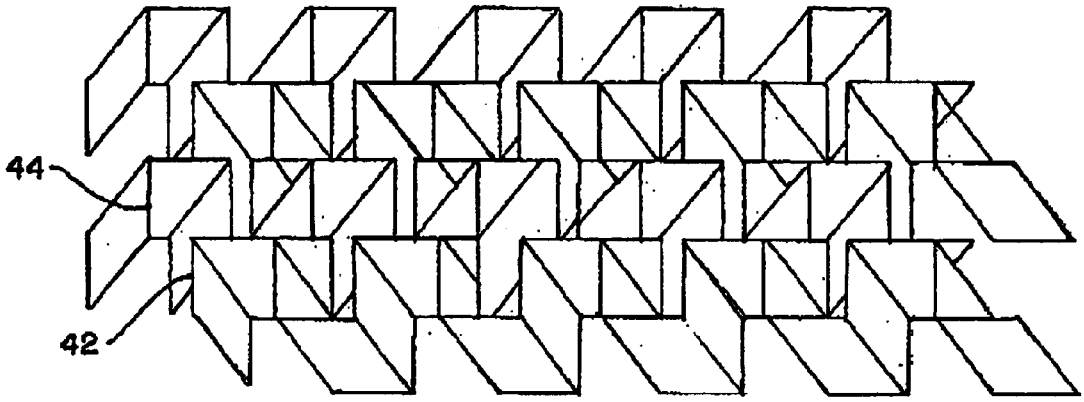
FIG. 2 is a first alternative square wave internal structure for use in the sandwich core of FIG. 1.
Figure 3:
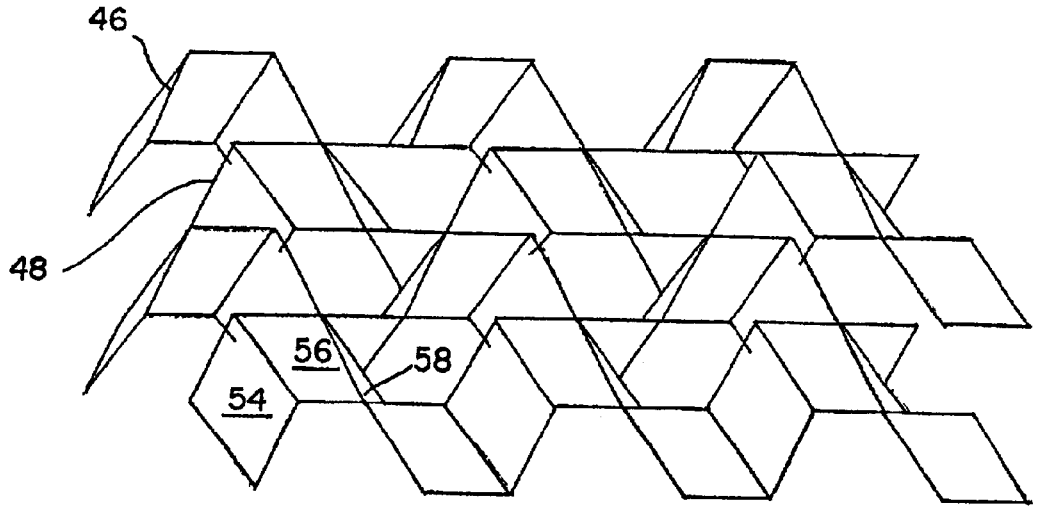
FIG. 3 is a second alternative trapezoidal wave internal structure for use in the sandwich core of FIG. 1.
Figure 4:
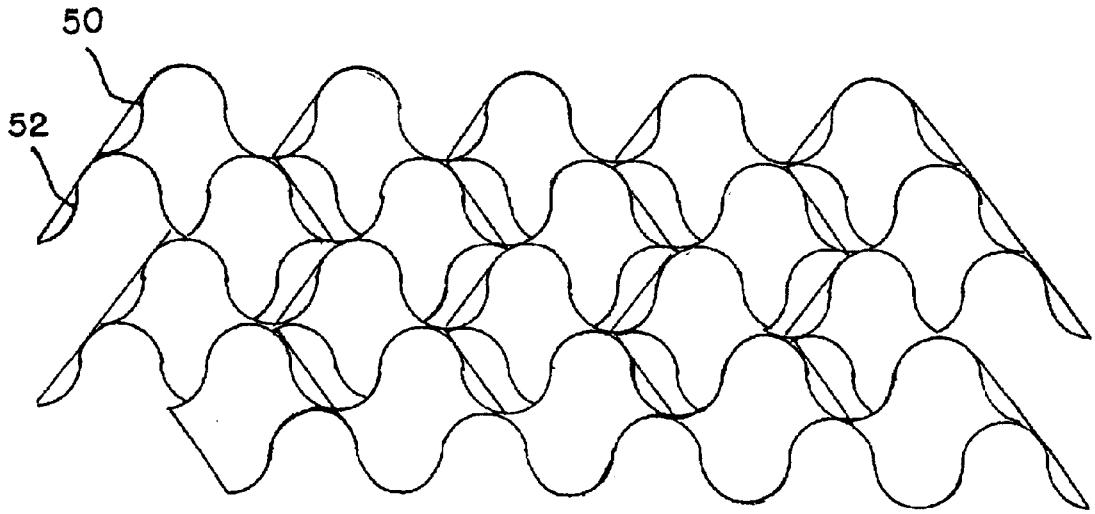
FIG. 4 is a third alternative sinusoidal wave for use in the sandwich core of FIG. 1.

The ribbon pattern of the first and second ribbons 34,36 is substantially rectangular as taken along a cross section parallel to at least one of the first or second faceplates 12,14, however other ribbon shapes could be utilized such as third and fourth ribbons 42,44 shown in FIG. 2 having cross sections representing square wave cross sections, fifth and sixth ribbons 46,48 shown in FIG. 3 having trapezoidal wave cross sections, seventh and eighth ribbons 50,52 shown in FIG. 4 having sinusoidal wave cross sections, or other appropriate geometric configuration.

Referring back to FIG. 3, in order to have a trapezoidal cross section, the ribbons 46,48 could have angles between the walls 54, 56, 58 of other than ninety degrees as taken along a plane parallel to the faceplates 12,14. Accordingly, the angles between some of the walls 54,56,58 could be about one hundred thirty five degrees so that the ribbon would represent half of a hexagon. In seventh and eighth ribbons 50,52 of FIG. 4, the angles continuously change along a curve in a sinusoidal manner.

It is anticipated that a particular cross section, such as either rectangular, square, trapezoidal, sinusoidal, etc., would be selected and utilized for a single core. The four different types could also be utilized with each other as well as with other cross section types in certain applications.

Referring back to FIG. 1, at least some, and preferably all, of the walls 18,20,22,24,26,28,30,32 are positioned at oblique angles relative to an axis, such as axes 34,36 which are illustrated extending through adjacent cells perpendicularly to planes containing the first and second faceplates 12,14. By oblique angles, the walls 18,20,22,24,26,28,30,32 are angled between 0 and 90 degrees relative to the axes 34,36. Accordingly along any axis proceeding through the faceplates 12,14 perpendicularly such as axes 38,40, if the axis were to contact any of the obliquely angled walls 18,20,22,24,26,28,30,32, then the axis would only contact the respective wall at a single point.

One way to visualize this concept is think of venetian blinds. In a traditional honeycomb design, the walls extend perpendicularly to the layers. In the venetian blind example, this would correspond to the blinds extending so that only an edge of the blinds would be visible to the observer looking through the blinds from a distance, such as across a room. In the present design, the oblique angle of the walls 18,20,22, 24,26,28,30,32 could be exemplified by angling the blinds, usually performed by twisting on a rod which rotates each of the blind members. The blind members remain parallel to one another during the process, but from the observer's perspective, sides of the blind members are now visible (i.e., the blinds are obliquely angled relative to the observer). Further twisting of the rod would eventually result in very little, if any light being transmitted through the blinds. In this position, the edge of the blinds may be at about 90 degrees to the observer. It doesn't make any difference which way the blinds are rotated, they would still be obliquely angled relative to the observer. Accordingly, if planar sheets were placed on the front and the back of the venetian blinds, we would have a readily recognizable visualization of a simplified design.

Carrying the above visualization over to the design of FIG. 1, the ribbons 34,36 are angled obliquely relative to the faceplates 12,14. In this embodiment, the cells 16 still allow for a direct path through at least some of the cells 16 (i.e., the oblique angle is relatively small and the walls 18,20,22, 24,26,28,30,32 extend in height (as measured between the faceplates 12,14) a relatively short distance. In other embodiments, it may be desirable to have a greater oblique angle (i.e., closer to 90 degrees than the approximately twenty degrees illustrated for 18,22, ten degrees for walls 20,24, forty five degrees for walls 28,32 and thirty degrees for walls 26,30).

Another visualization of the core design 10 would be to take two sheets of corrugated tin which is a relatively common building product used for roofing, especially of barns. Colored tin has recently come back in style for personal residences. With the tin sheet standing on edge perpendicular to the ground, the top of the tin sheet may be pushed away from the individual while the bottom remains on the ground. The tin sheet is now obliquely angled in the vertical direction. With the tin sheet in this position, it may then be rotated, with one corner remaining on the ground to the left, or right, to obliquely angle the tin sheet in another plane.

With the tin sheet held rigidly in this position, it may be sliced in "ribbons" by cutting strips, such as one inch wide, parallel to the ground. If the strip is placed upon its edge along one of the cuts, it should stand up. Of course, the angle of obliqueness as well as the width of the strip will determine whether or not the strip can stand up or not. With a plurality of strips on their edge on a piece of cardboard to represent the bottom face plate, a second piece of cardboard may be placed on the other edge along the other cut to form the top place plate. The strips represent the ribbons 12,14 of the preferred embodiment as they have the equivalent of walls angled obliquely to the cardboard "faceplates".

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A cross cell sandwich core structure comprising:

a first and second faceplate spaced apart from one another and substantially parallel to one another;

a plurality of spaced apart and separated ribbons located between the first and second faceplates, the ribbons extending in width from a top surface of the first faceplate to a bottom surface of the second faceplate and extending in length substantially parallel to one another along a length of the first and second faceplates, said ribbons extending continuously from the top surface of the first faceplate to the bottom surface of the second faceplate across the width of the ribbons, and the length of the ribbons being substantially longer than the width of the ribbons;

wherein each of the plurality of ribbons has at least one firs wall portion along the width of the respective ribbon, and said at least one first wall portion is obliquely angled relative to a first axis extending through said rust and second faceplates and the at least one first wall portion, said first axis perpendicular to the first and the second faceplates where it crosses through the first and second faceplates, respectively.

2. The cross cell sandwich core structure of claim 1 wherein at least one of the ribbons has a cross section as taken along a plane parallel to the first faceplate forming a substantially rectangular wave.

3. The cross cell sandwich core structure of claim 1 the plurality of ribbons are connected to the first faceplate.

4. The cross cell sandwich core structure of claim 3 wherein the plurality of ribbons are connected to the second faceplate.

5. The cross cell sandwich core structure of claim 1 wherein the first and second faceplates are planar.

6. The cross cell sandwich core structure of claim 1 further comprising a plurality of second wall portions of the plurality of ribbons obliquely angled relative to a second axis extending through the first and second faceplates, said second axis perpendicular to the first and second faceplates where the first axis extends through the first and second faceplates, respectively, and said second wall portion connected to and adjacent to the first wall portion.

7. The cross cell sandwich core structure of claim 6 wherein the first and second wall portions are angled at about ninety degrees relative to one another.

* * * * *